US011121495B2

(12) United States Patent
Hauck et al.

(10) Patent No.: US 11,121,495 B2
(45) Date of Patent: Sep. 14, 2021

(54) CONTACT PIN FOR CONNECTING ELECTRICAL CONDUCTORS MADE OF COPPER AND ALUMINUM

(71) Applicant: TE Connectivity Germany GmbH, Bensheim (DE)

(72) Inventors: Uwe Hauck, Kleinmanchow (DE); Helge Schmidt, Speyer (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/352,128

(22) Filed: Mar. 13, 2019

(65) Prior Publication Data

US 2019/0288434 A1 Sep. 19, 2019

(30) Foreign Application Priority Data

Mar. 13, 2018 (DE) ..... 102018203800.7

(51) Int. Cl.
*H01R 13/03* (2006.01)
*H01R 13/24* (2006.01)
(Continued)

(52) U.S. Cl.
CPC ..... *H01R 13/2471* (2013.01); *H01B 1/023* (2013.01); *H01B 1/026* (2013.01);
(Continued)

(58) Field of Classification Search
CPC ..... H01R 13/42; H01R 13/111; H01R 24/20; H01R 12/716; H01R 13/113; H01R 13/6587; H01R 13/514; H01R 12/585; H01R 12/53; H01R 12/724; H01R 12/737; H01R 13/03; H01R 13/631; H01R 13/6474; H01R 13/6594; H01R 43/205; H01R 43/24; H01R 12/51; H01R 12/58; H01R 12/61; H01R 12/707; H01R 12/7082;
(Continued)

(56) References Cited

U.S. PATENT DOCUMENTS 4,098,449 A 7/1978 Noesen
5,032,421 A * 7/1991 Sarma ..... C23C 14/022 427/535
(Continued)

FOREIGN PATENT DOCUMENTS

DE 202017100572 U1 5/2017
WO 2016083198 A1 6/2016

OTHER PUBLICATIONS

German Office Action, German Patent Application No. 10 2018 203 800.7, dated Jan. 29, 2019.
Abstract of DE 202017100572 U1, dated May 24, 2017, 1 page.

*Primary Examiner* — Truc T Nguyen
(74) *Attorney, Agent, or Firm* — Barley Snyder

(57) ABSTRACT

A contact pin for connecting a first electrical conductor made of copper or a copper alloy and a second electrical conductor made of aluminum or an aluminum alloy comprises a plug-in section, a connecting section, and a coating disposed at least on the connecting section. The plug-in section is adapted to couple to the first electrical conductor. The connecting section is adapted to connect to the second electrical conductor. The coating is corrosion-resistant and compatible with aluminum and copper.

22 Claims, 3 Drawing Sheets

(51) Int. Cl.
*H01B 1/02* (2006.01)
*H01R 12/58* (2011.01)
*H01R 4/26* (2006.01)
*H01R 4/62* (2006.01)

(52) U.S. Cl.
CPC ..... *H01R 4/26* (2013.01); *H01R 4/62* (2013.01); *H01R 12/585* (2013.01); *H01R 13/03* (2013.01)

(58) Field of Classification Search
CPC ..... H01R 12/72; H01R 12/77; H01R 13/025; H01R 13/20; H01R 13/426; H01R 13/504; H01R 13/508; H01R 13/518; H01R 13/5202; H01R 13/521; H01R 13/5224; H01R 13/582; H01R 13/6205; H01R 13/6581; H01R 13/6582; H01R 13/6584; H01R 13/6598; H01R 13/665; H01R 13/6658; H01R 13/719; H01R 13/74; H01R 2103/00; H01R 24/50; H01R 25/006; H01R 27/02; H01R 43/0221; H01R 43/0256; H01R 4/025; H01R 4/26; H01R 9/0515
See application file for complete search history.

(56) References Cited

U.S. PATENT DOCUMENTS 5,073,118 A * 12/1991 Grabbe ..... H01R 12/58 439/71
5,453,016 A * 9/1995 Clark ..... H01R 43/205 439/79
6,071,127 A * 6/2000 Acke ..... H01R 24/50 439/63
6,183,885 B1 * 2/2001 Nakamura ..... H01R 13/03 428/647
6,183,886 B1 * 2/2001 Chen ..... C23C 28/00 148/537
7,029,760 B2 * 4/2006 Mori ..... B32B 15/017 205/226
8,101,285 B2 * 1/2012 Mitose ..... C25D 5/50 428/607
9,093,780 B2 * 7/2015 Miyake ..... H01R 12/585
9,331,412 B2 5/2016 Moser
9,455,502 B2 * 9/2016 Guenter ..... H01R 12/585
9,490,550 B2 * 11/2016 Otsuka ..... H01R 4/62
9,915,003 B2 * 3/2018 Gaertner ..... H01R 13/03
9,966,163 B2 * 5/2018 Sawada ..... C25D 5/12
2003/0079997 A1 * 5/2003 Franz ..... C23C 2/02 205/170
2005/0153597 A1 * 7/2005 Schaty ..... H01R 4/307 439/521
2006/0025024 A1 * 2/2006 Yamagami ..... H01R 13/03 439/886
2008/0318453 A1 * 12/2008 Dancison ..... H01R 12/585 439/82
2010/0294539 A1 * 11/2010 Sasaki ..... C23C 18/1635 174/126.4
2011/0014825 A1 * 1/2011 Drew ..... H01R 13/03 439/877
2012/0289102 A1 * 11/2012 Moll ..... H01R 12/585 439/890
2015/0136456 A1 * 5/2015 Bednarek ..... C22C 18/00 174/256
2016/0028177 A1 * 1/2016 Nomura ..... C23C 22/52 439/874
2016/0064847 A1 * 3/2016 Gaertner ..... C23C 28/321 439/741
2017/0331205 A1 11/2017 Kruger et al.
2018/0138610 A1 * 5/2018 Goto ..... H01R 43/16
2018/0261936 A1 * 9/2018 Kawate ..... H01R 12/585
2018/0269603 A1 * 9/2018 Zeigmeister ..... C25D 7/00
2018/0337475 A1 11/2018 Teichmann et al.

* cited by examiner

CONTACT PIN FOR CONNECTING ELECTRICAL CONDUCTORS MADE OF COPPER AND ALUMINUM

CROSS-REFERENCE TO RELATED APPLICATION

This application claims the benefit of the filing date under 35 U.S.C. § 119(a)-(d) of German Patent Application No. 102018203800.7, filed on Mar. 13, 2018.

FIELD OF THE INVENTION

The present invention relates to a contact pin and, more particularly, to a contact pin for connecting an electrical conductor made of copper or a copper alloy and an electrical conductor made of aluminum or an aluminum alloy.

BACKGROUND

A contact pin is used to connect current conductors, such as a circuit board and a busbar for car batteries. The contact pin can be produced from wires which can be affixed to the circuit board by soldering or have a spring with which the contact pin can be pressed into the circuit board.

Contact pins made of a copper alloy have an appropriate solidity, deformability, and electrical conductivity. It is desirable to use current conductors made of a cheaper material with a lighter weight, such as aluminum or an aluminum alloy. Copper, however, has a much higher electrochemical potential than aluminum and, consequently, contact corrosion occurs when the copper and aluminum come into contact if an electrolyte such as condensed water is present. There is a need for an inexpensive, viable, and corrosion resistant connection between a copper-based current conductor and an aluminum-based current conductor.

SUMMARY

A contact pin for connecting a first electrical conductor made of copper or a copper alloy and a second electrical conductor made of aluminum or an aluminum alloy comprises a plug-in section, a connecting section, and a coating disposed at least on the connecting section. The plug-in section is adapted to couple to the first electrical conductor. The connecting section is adapted to connect to the second electrical conductor. The coating is corrosion-resistant and compatible with aluminum and copper.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
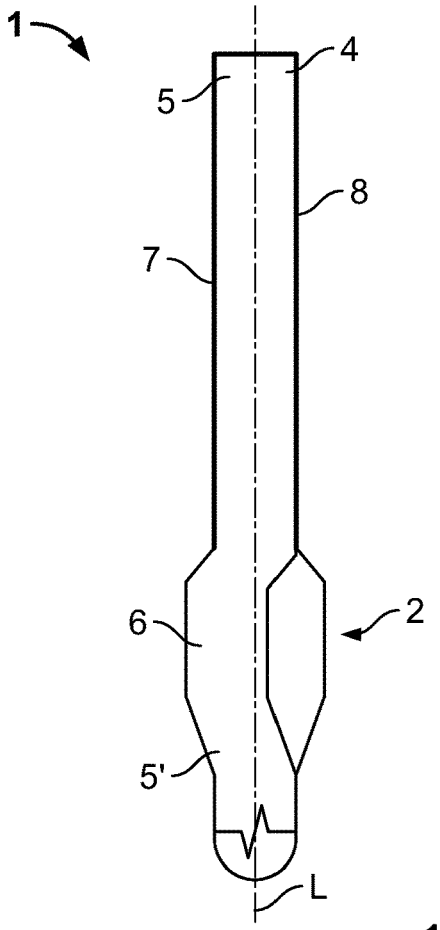
FIG. 1 is a side view of a contact pin according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

A contact pin 1 according to an embodiment is shown in FIG. 1. The contact pin 1 extends along a longitudinal axis L and comprises a plug-in section 2 for coupling to a first electrical conductor made of copper or a copper alloy and a connecting section 4 for connecting to a second electrical conductor made of aluminum or an aluminum alloy. The connecting section 4 is disposed at a first free end 5 of the contact pin 1 and the plug-in section 2 is disposed at a second free end 5' of the contact pin 1 opposite the first free end 5 along the longitudinal axis L.

The plug-in section 2, as shown in FIG. 1, is formed by a radially elastic resilient section 6 which enables elastic pressing into a receptacle of the first electrical conductor made of copper or a copper alloy. The resilient section 6 is broadened outwards substantially perpendicular to the longitudinal axis L and is elastically deformable inwards substantially perpendicular to the longitudinal axis L.

The connecting section 4, as shown in FIG. 1, is configured to be peg-shaped and is adapted to couple to an aluminum-based electrical conductor. The connecting section 4 extends along the longitudinal axis L up to the plug-in section 2 and has a constant outer shape 7 along the longitudinal axis L.

The contact pin 1 is formed from copper and/or a copper alloy. The elastic resilient section 6 in particular is made of a copper alloy, in order to enable elastic deformability for the pressing-in into the first electrical conductor made of copper or a copper alloy. In an embodiment, the resilient section 6 has a different material composition than a material composition of the rest of the contact pin 1.

As shown in FIG. 1, at least the connecting section 4 is coated with a coating 8 that is corrosion-resistant for aluminum and copper. The coating 8 prevents contact corrosion between the aluminum of the electrical conductor and the copper of the contact pin. Since the copper has a much higher electrochemical potential than aluminum, contact corrosion occurs when the two substances come into contact, if an electrolyte such as condensed water is present. The electrochemical potential of the coating 8 lies between the electrochemical potential of copper and of aluminum.

In an embodiment, the coating 8 is single-layered and consists of a tin-zinc alloy, with the percentage by weight of zinc being between approximately 5% and approximately 75%, and in an embodiment, is 20%. The coating 8 is galvanically deposited onto the connecting section 4 and is between approximately 0.5 and approximately 5 μm thick. In the embodiment shown in FIG. 1, the coating 8 that is corrosion-resistant for aluminum and copper is applied only on the connecting section 4. In another embodiment, the contact pin 1 can be completely coated with the corrosion-resistant coating 8. In an embodiment, the plug-in section 2 can be coated with a coating that is different from the coating 8. The plug-in section 2 can be tin-coated, for example, in order to guarantee a corrosion-resistant connection to the copper-based electrical conductor.

Figure 2:
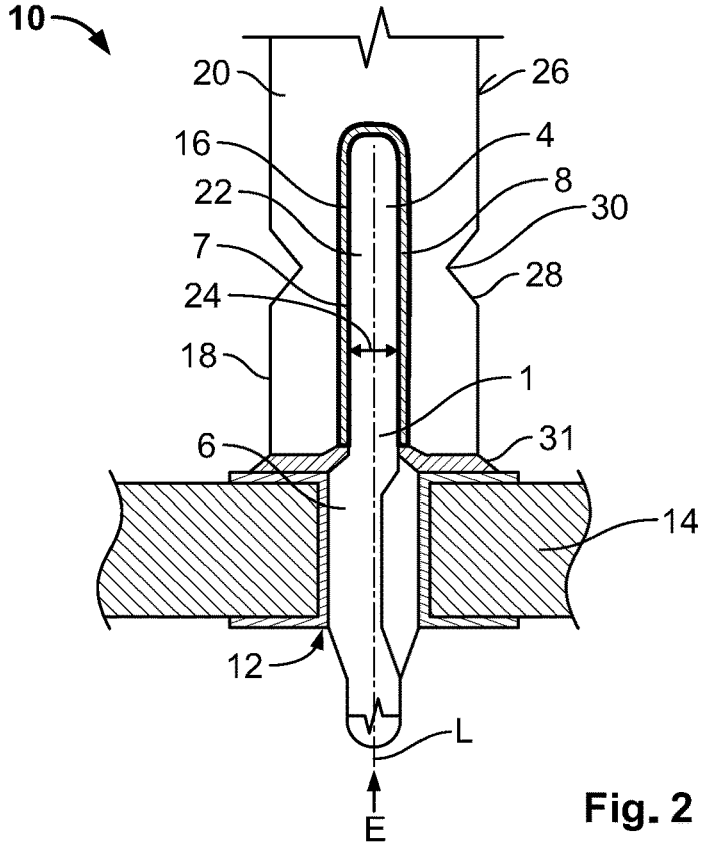
FIG. 2 is a sectional side view of an arrangement according to an embodiment.

As shown in FIG. 2, an arrangement 10 using the contact pin 1 further comprises a first electrical conductor 14 made of copper or a copper alloy and a second electrical conductor 20 made of aluminum or an aluminum alloy. In an embodiment, the first electrical conductor 14 is a circuit board and the second electrical conductor 20 is a busbar. In an embodiment, the second electrical conductor 20 is produced by deep-drawing, extrusion, or stamping.

The contact pin 1, as shown in FIG. 2, is plugged with the plug-in section 2 into a receptacle 12 of the first electrical conductor 14. The receptacle 12 penetrates the first electrical conductor 14 along the longitudinal axis L. A width of the resilient section 6, in a non-plugged-in state, is larger than a width of the receptacle 12. When pressed-in, the resilient section 6 is radially deformed inwards perpendicular to the longitudinal axis L, so that high driving forces arise between the resilient section 6 and the receptacle 12. As a result, there arises a gas-tight zone and a low-impedance electrical connection between the contact pin 1 and the first electrical conductor 14.

The peg-shaped connecting section 4, as shown in FIG. 2, is introduced in a coupling section 16, which has the form of a socket 18, of the second electrical conductor 20. The connecting section 4 and the coupling section 16 are configured to be complementary so that a good fit and a good hold can be achieved between the two. The connecting section 4 has a constant outer shape 7 along the longitudinal axis L, while the socket 18 has an aperture 22 which extends along the longitudinal axis and which has a constant inner width 24 along the longitudinal axis. In an embodiment, the connecting section 4 and the coupling section 16 each have a cross-section that is constant along a plug-in direction E. In an embodiment, an inner cross-section of the coupling section 16 and an outer shape of the connecting section 4 are rotationally symmetrical. As a result, the plugging-together of the contact pin 1 and the second electrical conductor 20 is facilitated.

By virtue of the coating 8, a corrosion of the aluminum of the second electrical conductor 20 and of the copper of the contact pin 1 is prevented. As a result, a simple connection of the first electrical conductor 14 made of copper or a copper alloy and the second electrical conductor 20 made of aluminum or an aluminum alloy is possible with the contact pin 1. The coating 8 is optimized for a connection to the aluminum and to the copper.

As shown in FIG. 2, the connecting section 4 is introduced in a plug-in direction E, which runs parallel to the longitudinal axis L, into the aperture 22 of the second electrical conductor 20. This can be carried out by the application of force so that the contact pin 1 and the second electrical conductor 20 are pressed together. In order to further strengthen the cohesion, the coupling section 16 can be welded, soldered and/or crimped to the connecting section 4.

In various embodiments, the second electrical conductor 20 can connect to a current conductor, such as a busbar or an accumulator, for example. Depending on the application, the length of the second electrical conductor 20 can be adapted. The second electrical conductor 20 can, for example, have a closed pin-shaped free end which faces away from the coupling section 16 and which can be connected to the current conductor by pressing, soldering, or by some other method. Furthermore, the second electrical conductor 20 can be outwardly insulated by an electrically non-conductive casing in order to avoid short-circuiting.

As shown in FIG. 2, the second electrical conductor 20 has at its outer surface 26 a clamping zone 28 which is formed by an indentation 30. Through an action of mechanical force onto this clamping zone 28, the contact pin 1 and the second electrical 20 are squeezed together.

The electrical conductors 14, 20, as shown in FIG. 2, are spaced apart from one another in plug-in direction E. In order to avoid contact between the electrical conductors 14, 20, the arrangement 10 has a polymer-containing sealing body 31 between the two electrical conductors 14, 20. The sealing body 31 can be formed by capillary casting. The sealing body 31 prevents dirt and condensed water from ending up between the electrical conductors 14, 20. In an embodiment, the sealing body 31 is a sealing ring or a potting between the electrical conductors 14, 20 and is made of an insulating polymer.

Figure 3:
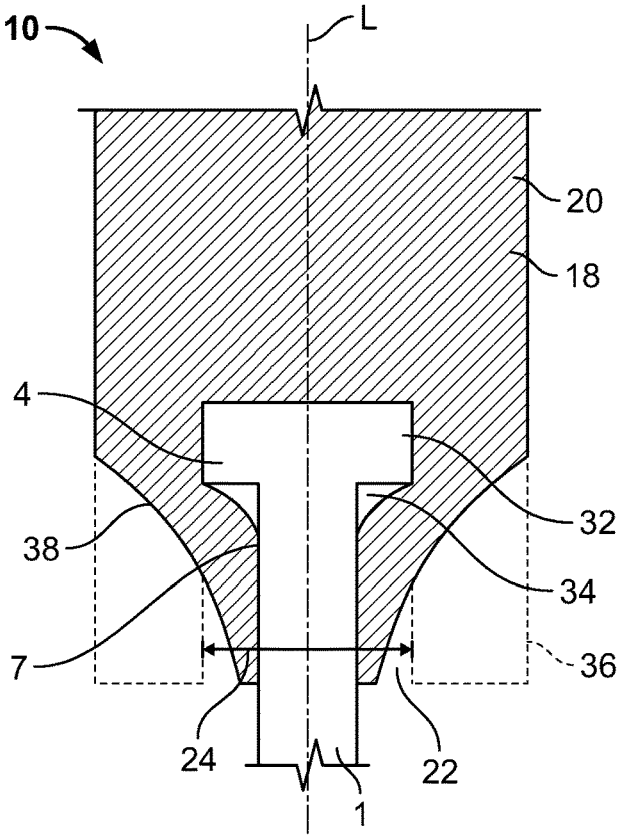
FIG. 3 is a sectional side view of an arrangement according to another embodiment.

In another embodiment of an arrangement 10 shown in FIG. 3, the connecting section 4 of the contact pin 1 has at least one shoulder 32 that protrudes laterally relative to the longitudinal axis L. As a result, when the second electrical conductor 20 and the contact pin 1 are squeezed together, at least one undercut 34 is formed in order to strengthen the connection between the contact pin 1 and the second electrical conductor 20 in a form-fitting manner.

In the unsqueezed state 36, shown in FIG. 3, the socket 18 has an aperture 22 with an unvarying inner width 24. The outer shape 7 of the connecting section 4 has, at its side facing away from the first electrical conductor 14, the shoulder 32 which protrudes laterally perpendicular to the longitudinal axis L and which can have a blade-shaped surface structure in order to support an ingress into the socket 18. The breadth of the shoulder 32 is designed to be complementary to the aperture 22 so that the connecting section 4 can be easily introduced into the socket 18. During the squeezing-together, the aperture 22 narrows until the inner surface of the aperture 22 lies against the outer shape 7 of the connecting section 4. A friction-locking connection arises and a form-fitting connection arises due to the shoulder 32 located in the formed undercut 34. The squeezed state 38 is shown with a solid line in FIG. 3 and the unsqueezed state 36 is depicted with a dashed line.

Figure 4:
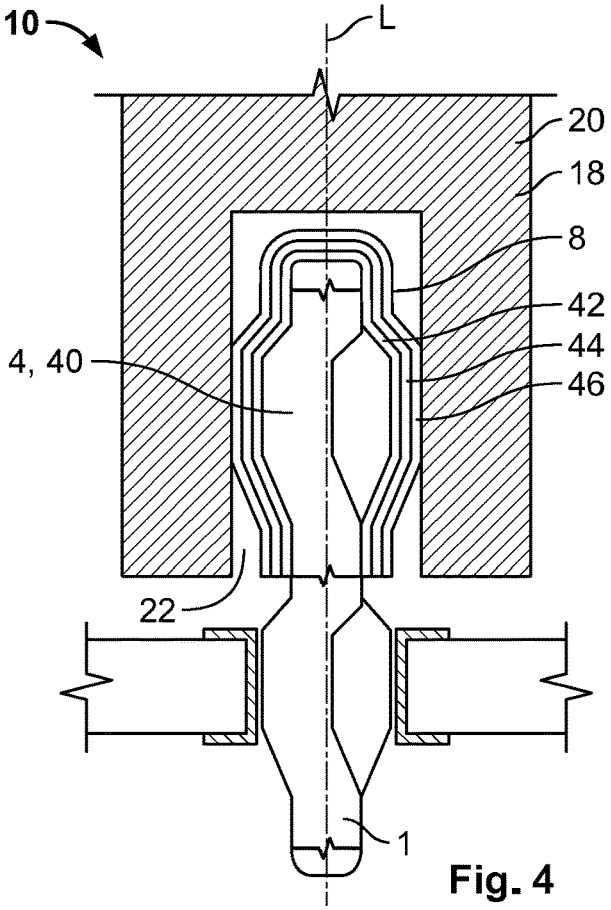
FIG. 4 is a sectional side view of an arrangement according to another embodiment.

In an arrangement 10 according to another embodiment, as shown in FIG. 4, the contact pin 1 has a second radially elastic resilient section 40 which forms the connecting section 4. The coating 8 is applied in three layers 42, 44, 46. The first layer 42 consists of nickel and is applied on the outer surface of the connecting section 4. The second layer 44 consists of zinc and the third layer 46 consists of tin.

The nickel from the first layer 42 connects to the copper of the contact pin 1 and serves as a diffusion-blocking layer. The first layer 42 prevents an interdiffusion between the copper atoms and the atoms of the coating 8 or aluminum of the second electrical conductor 20. The formation of intermetallic Cu—Al compounds with high electrical resistances is inhibited by the diffusion-blocking layer. The tin from the third layer 46 contacts the aluminum of the second electrical conductor 20. As a result, there occurs at least a partial interdiffusion between the atoms of the two materials, and the connection between the second electrical conductor 20 and the contact pin 1 is strengthened.

The second resilient section 40 is plugged into the aperture 22 of the second electrical conductor 20, as shown in FIG. 4. Due to the press-connection between the contact pin 1 and the second electrical conductor 20, a clamping zone 28, as shown in FIG. 2, is not required. The second electrical conductor 20 therefore has a constant breadth.

Figure 5:
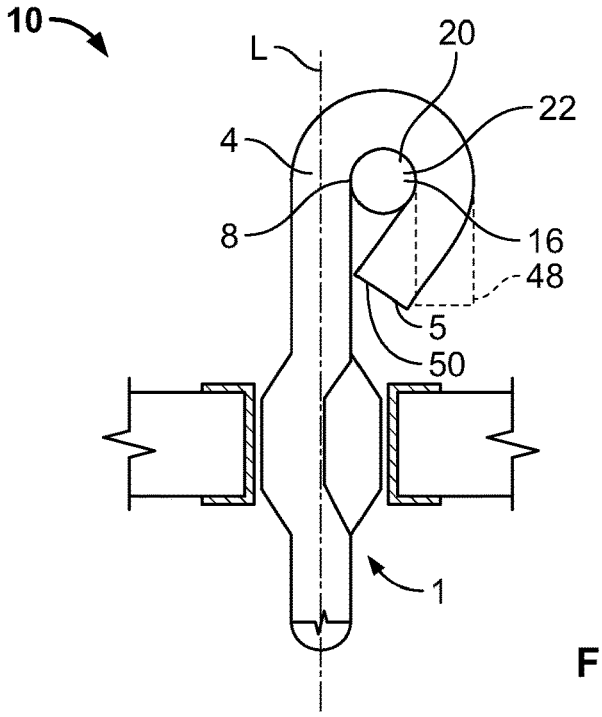
FIG. 5 is a sectional side view of an arrangement according to another embodiment.

An arrangement 10 according to another embodiment is shown in FIG. 5. The first free end 5 of the connecting section 4 is substantially bent back by 180° and forms an aperture 22 between the free end 5 of the connecting section 4 and an end of the connecting section 4 adjacent the plug-in section 2. The connecting section 4 is deformed in a hook-shaped manner in a non-clamped state 48. A peg-shaped coupling section 16 of the second electrical conductor 20 can be plugged through into the aperture 22 so that the coupling section 16 is arranged substantially parallel to the first electrical conductor 14. In order to strengthen the connection between the connecting section 4 and the coupling section 16, the free end 5, in a clamped state 50, is bent inwards to that end of the connecting section 4 which is adjacent the plug-in section 2. In the clamped state 50, the aluminum-based second electrical conductor 20 is connected to the contact pin 1 in a friction-locking manner. The embodiment of FIG. 5 makes it possible to contact a current conductor parallel to the plane of the first electrical conductor 14 and is advantageous when there is limited space.

Figure 6:
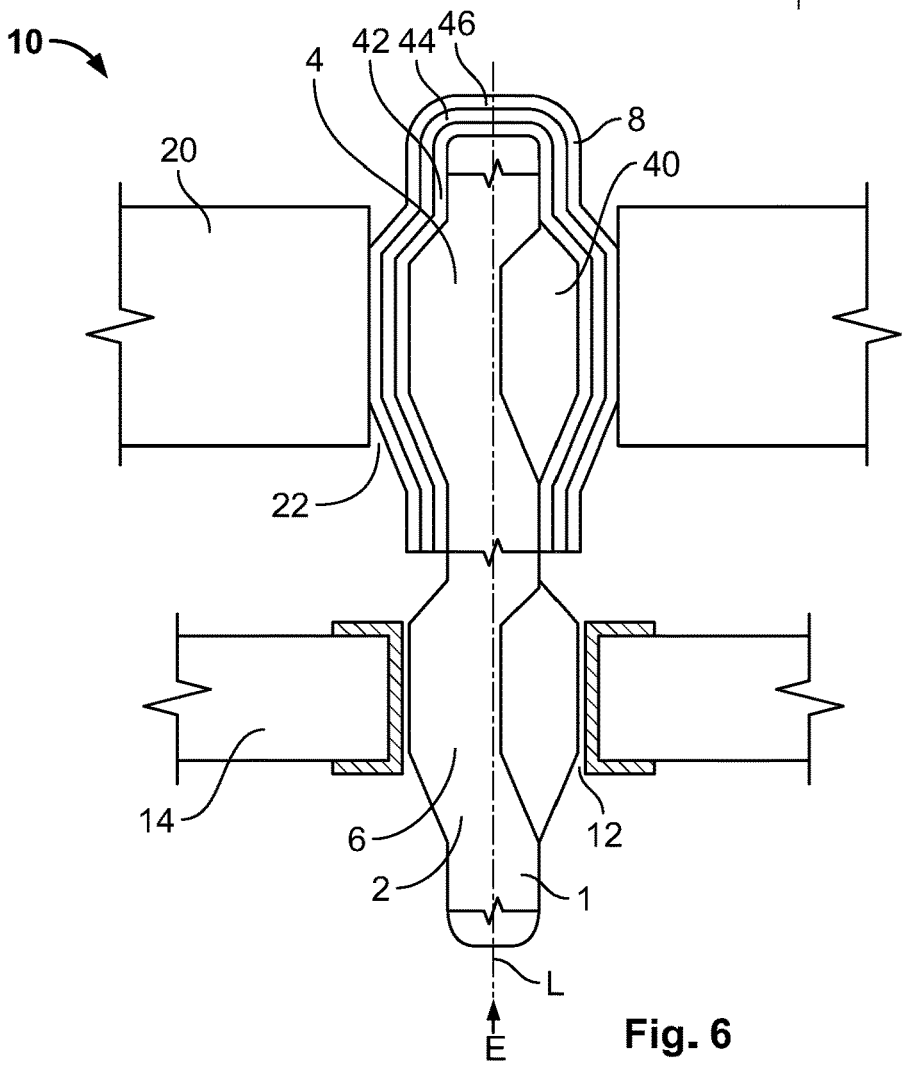
FIG. 6 is a sectional side view of an arrangement according to another embodiment.

An arrangement 10 according to another embodiment is shown in FIG. 6. The contact pin 1, as shown in the embodiment of FIG. 4, has a first radially elastic resilient section 6 for elastically pressing into the receptacle 12 of the first electrical conductor 14 and a second radially elastic resilient section 40 for elastically pressing into an aperture 22 of the second electrical conductor 20. The electrical conductors 14, 20 are configured here as flat conductors or busbars. The receptacle 12 penetrates the copper-based first electrical conductor 14 along the longitudinal axis L of the contact pin 1. The contact pin 1 is plugged into the receptacle 12 against the plug-in direction E by its plug-in section 2. The second radially elastic resilient section 40 forms the connecting section 4 and is plugged into the aperture 22 which penetrates the second electrical conductor 20 along the plug-in direction E.

The connecting section 4, as shown in FIG. 6, has a three-layered coating 8. The first layer 42 consists of nickel and is applied directly onto the connecting section 4. The second layer 44 consists of zinc and the third layer 46 consists of tin. The third layer 46 of the contact pin 1 points outwards and thus contacts the aluminum of the second electrical conductor 20.

A width of the resilient sections 40, 6, in the non-plugged-in state, is larger than a width of the aperture 22 or receptacle 12. When plugged into the aperture 22 or receptacle 12, the resilient sections 40, 6 deform radially inwards perpendicular to the longitudinal axis L, so that high driving forces come into being between the resilient sections 6, 40 and the receptacle 12 or aperture 22. This leads to a gas-tight zone and a low-impedance electrical connection between the contact pin 1 and the electrical conductors 14, 20.

In an embodiment, the coating 8 can be up to 5 μm thick, and the individual layers 42, 44, 46 can have different thickness. In another embodiment, the individual layers 42, 44, 46 can have a same thickness. As a result, the coating 8, depending on the use, can be optimized for the connection between the first electrical conductor 14 and the second electrical conductor 20. With the coating 8, contact corrosion can be prevented from occurring between the copper of the contact pin 1 and the aluminum of the second electrical conductor aluminum alloy 20. With the arrangement 10 shown in FIG. 6, it is possible to create a simple connection between two flat conductors or busbars, with one flat conductor consisting of copper or a copper alloy and the other flat conductor consisting of aluminum or an aluminum alloy.

What is claimed is:

1. A contact pin for connecting a first electrical conductor made of copper or a copper alloy and a second electrical conductor made of aluminum or an aluminum alloy, comprising:

a plug-in section adapted to couple to the first electrical conductor;

a connecting section adapted to connect to the second electrical conductor;

a coating having a plurality of layers including a layer consisting of zinc disposed at least on the connecting section and not on the plug-in section, the coating is corrosion-resistant and compatible with aluminum and copper; and a radially elastic resilient section adapted to press onto either the first electrical conductor or the second electrical conductor.

2. The contact pin of claim 1, wherein the coating has a thickness of 0.5 to 5 μm.

3. The contact pin of claim 1, wherein the coating has a diffusion blocking layer.

4. The contact pin of claim 1, wherein the coating has a layer of nickel.

5. An arrangement, comprising:

a first electrical conductor made of copper or a copper alloy;

a second electrical conductor made of aluminum or an aluminum alloy; and a contact pin having a plug-in section coupled to the first electrical conductor, a connecting section connected to the second electrical conductor, and a coating having a plurality of layers including a layer consisting of zinc disposed at least on the connecting section and not on the plug-in section, the coating is corrosion-resistant and compatible with aluminum and copper, the connecting section is introduced in a plug-in direction parallel to a longitudinal axis of the contact pin into an aperture of the second electrical conductor.

6. The arrangement of claim 5, further comprising a polymer-containing sealing body disposed between the first electrical conductor and the second electrical conductor.

7. The arrangement of claim 5, wherein the contact pin is pressed into at least one of the first electrical conductor and the second electrical conductor.

8. The arrangement of claim 5, wherein the first electrical conductor is disposed parallel to the second electrical conductor and perpendicular to a longitudinal axis of the contact pin.

9. The arrangement of claim 5, wherein the second electrical conductor is a busbar.

10. The contact pin of claim 4, wherein the contact pin is made of copper or a copper alloy.

11. The contact pin of claim 10, wherein the layer of nickel is in contact with the copper or copper alloy of the contact pin.

12. The contact pin of claim 11, wherein the layers of the coating include a layer consisting of tin.

13. The contact pin of claim 12, wherein the layer consisting of zinc is disposed between the layer of nickel and the layer consisting of tin.

14. The arrangement of claim 5, wherein the second electrical conductor has a clamping zone formed by an indentation at an outer surface of the second electrical conductor, the contact pin and the second electrical conductor are squeezed together at the clamping zone.

15. The arrangement of claim 5, wherein the connecting section has a shoulder that protrudes laterally relative to a longitudinal axis of the contact pin.

16. The arrangement of claim 15, wherein a width of the shoulder is complementary to a width of the aperture.

17. The arrangement of claim 16, wherein the second electrical conductor is deformed around the shoulder at the aperture and forms an undercut between the contact pin and the second electrical conductor.

18. The arrangement of claim 5, wherein a free end of the connecting section is bent back and forms an aperture in which the second electrical conductor is inserted.

19. An arrangement, comprising:

a first electrical conductor made of copper or a copper alloy;

a second electrical conductor made of aluminum or an aluminum alloy;

a contact pin having a plug-in section coupled to the first electrical conductor, a connecting section connected to the second electrical conductor, and a coating having a plurality of layers including a layer consisting of zinc disposed at least on the connecting section and not on the plug-in section, the coating is corrosion-resistant and compatible with aluminum and copper; and a polymer-containing sealing body disposed between the first electrical conductor and the second electrical conductor.

20. An arrangement, comprising:

a first electrical conductor made of copper or a copper alloy;

a second electrical conductor made of aluminum or an aluminum alloy; and a contact pin having a plug-in section coupled to the first electrical conductor, a connecting section connected to the second electrical conductor, and a coating having a plurality of layers including a layer consisting of zinc disposed at least on the connecting section and not on the plug-in section, the coating is corrosion-resistant and compatible with aluminum and copper, the contact pin is pressed into at least one of the first electrical conductor and the second electrical conductor.

21. An arrangement, comprising:

a first electrical conductor made of copper or a copper alloy;

a second electrical conductor made of aluminum or an aluminum alloy; and a contact pin having a plug-in section coupled to the first electrical conductor, a connecting section connected to the second electrical conductor, and a coating having a plurality of layers including a layer consisting of zinc disposed at least on the connecting section and not on the plug-in section, the coating is corrosion-resistant and compatible with aluminum and copper, the first electrical conductor is disposed parallel to the second electrical conductor and perpendicular to a longitudinal axis of the contact pin.

22. An arrangement, comprising:

a first electrical conductor made of copper or a copper alloy;

a second electrical conductor made of aluminum or an aluminum alloy, the second electrical conductor is a busbar; and a contact pin having a plug-in section coupled to the first electrical conductor, a connecting section connected to the second electrical conductor, and a coating having a plurality of layers including a layer consisting of zinc disposed at least on the connecting section and not on the plug-in section, the coating is corrosion-resistant and compatible with aluminum and copper.

* * * * *